US009643243B2

(12) United States Patent
Chen et al.

(10) Patent No.: US 9,643,243 B2
(45) Date of Patent: May 9, 2017

(54) PRESSURE CASTING MACHINE

(71) Applicant: JI ZHUN PRECISION INDUSTRY (HUI ZHOU) CO., LTD, Huizhou (CN)

(72) Inventors: Tang-Quan Chen, Shenzhen (CN); Xian-He Li, Shenzhen (CN); Xiao-Bo Yuan, Shenzhen (CN); Yi-Min Jiang, Shenzhen (CN); Jun-Qi Li, Shenzhen (CN)

(73) Assignee: JI ZHUN PRECISION INDUSTRY (HUI ZHOU) CO., LTD., Huizhou (CN)

( * ) Notice: Subject to any disclaimer, the term of this patent is extended or adjusted under 35 U.S.C. 154(b) by 14 days.

(21) Appl. No.: 14/583,081

(22) Filed: Dec. 24, 2014

(65) Prior Publication Data

US 2015/0174652 A1 Jun. 25, 2015

(30) Foreign Application Priority Data

Dec. 25, 2013 (CN) ..... 2013 1 0724484

(51) Int. Cl.

| | |
|---|---|
| ***B22D 17/14*** | (2006.01) |
| ***B22D 17/20*** | (2006.01) |
| ***B22D 17/12*** | (2006.01) |
| *B22D 17/22* | (2006.01) |

(52) U.S. Cl.

CPC ..... *B22D 17/14* (2013.01); *B22D 17/12* (2013.01); *B22D 17/2015* (2013.01); *B22D 17/22* (2013.01); *B22D 17/2236* (2013.01)

(58) Field of Classification Search

CPC ..... B22D 17/00; B22D 17/12; B22D 17/14; B22D 17/22; B22D 17/2236; B22D 17/2015

See application file for complete search history.

(56) References Cited

U.S. PATENT DOCUMENTS 3,528,478 A * 9/1970 Navarro ..... B22D 17/00 164/113

FOREIGN PATENT DOCUMENTS

| | | | | |
|---|---|---|---|---|
| CN | 203292455 U | | 11/2013 | |
| EP | 2489451 A2 | * | 8/2012 | ..... B22D 17/14 |
| WO | WO 2013086990 A1 | * | 6/2013 | ..... B22D 17/10 |

* cited by examiner

*Primary Examiner* — Kevin P Kerns
*Assistant Examiner* — Steven Ha
(74) *Attorney, Agent, or Firm* — Steven Reiss

(57) ABSTRACT

A pressure casting machine can be configured to mold a molten material into a workpiece. The pressure casting machine can include a vacuum chamber and a pressure casting mechanism coupled to the vacuum chamber. The vacuum chamber can include a processing section having a top wall and a bottom wall opposite to the top wall, a first gate configured to seal the processing section, and a first vacuum pump coupled to the processing section. The pressure casting mechanism can include a first driver positioned adjacent to the top wall, a first core received in the processing section and coupled to the first driver, a second core received in the processing section, and a plurality of pushing members received in the processing section. The second core can be coupled to the bottom wall and opposite to the first core. The pushing members can be coupled to the top wall.

19 Claims, 2 Drawing Sheets

PRESSURE CASTING MACHINE

FIELD

The subject matter herein generally relates to pressure casting machines, and particularly relates to a hermetical pressure casting machine.

BACKGROUND

When a compression molding processor needs to be carried out in an anaerobic condition, a hermetical pressure casting machine can be used.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
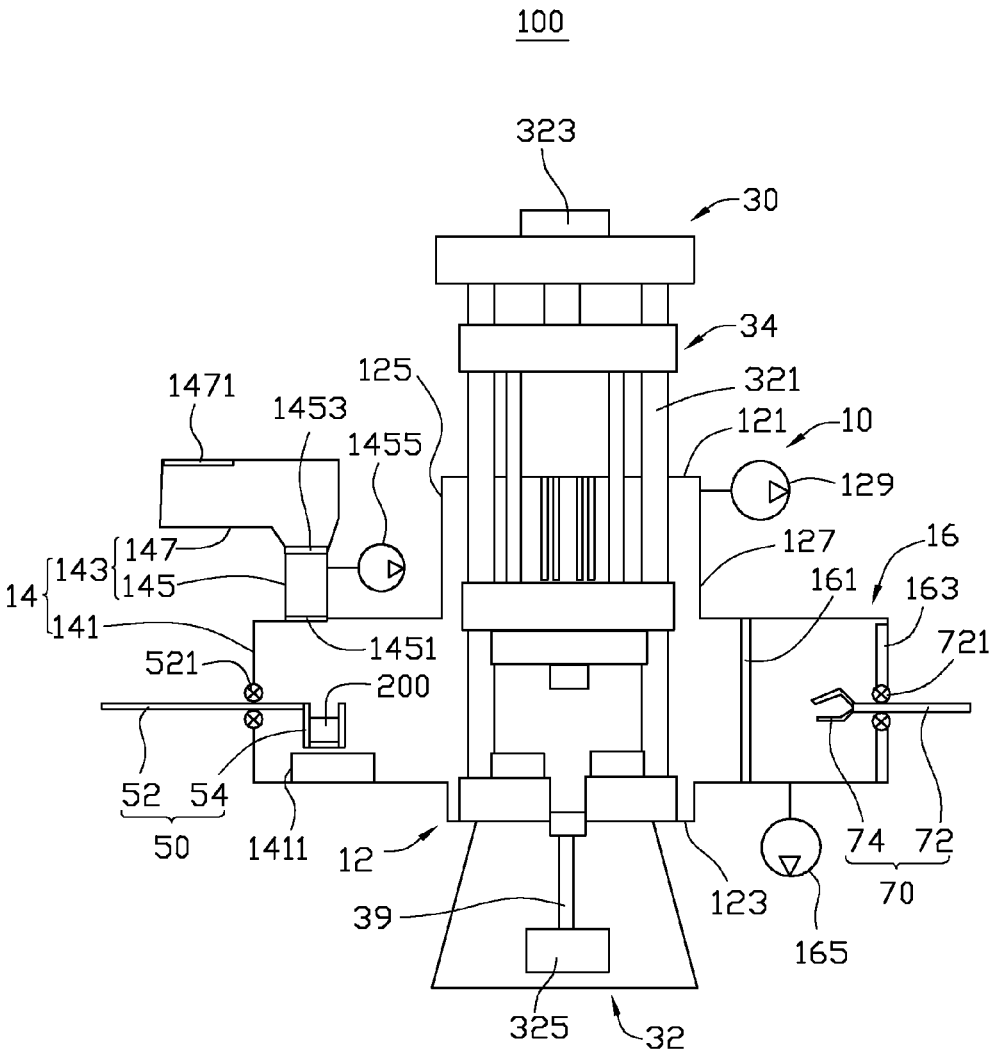
FIG. 1 is a diagrammatic view of a pressure casting machine, the pressure casting machine including a pressure casting mechanism.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

The present disclosure is described in relation to pressure casting machines, and particularly relates to a hermetically sealed pressure casting machine.

A pressure casting machine can be configured to mold a molten material into a workpiece and can include a vacuum chamber and a pressure casting mechanism coupled to the vacuum chamber. The vacuum chamber can include a processing section having a top wall and a bottom wall opposite to the top wall, a first gate configured to seal the processing section, and a first vacuum pump coupled to the processing section. The pressure casting mechanism can include a first driver positioned adjacent to the top wall, a first core received in the processing section and coupled to the first driver, a second core received in the processing section, and a plurality of pushing members received in the processing section. The second core can be coupled to the bottom wall and opposite to the first core. The pushing members can be coupled to the top wall, and positioned between the top wall and the first core. The first driver can be configured to move the first core to engage with the second core to complete a molding processor, and move the first core away from the second core and towards the pushing members, enabling the pushing members to insert through the first core and push out the workpiece on the first core.

FIG. 1 illustrates an embodiment of a pressure casting machine 100 configured to mold a molten material 200. In the illustrated embodiment, the molten material 200 can be made from a raw material of amorphous alloy. The pressure casting machine 100 can be a vertical compression molding machine, and can include a vacuum chamber 10, a pressure casting mechanism 30, a feeding mechanism 50, and a picking mechanism 70.

The vacuum chamber 10 can be a hermetical chamber, and can include a processing section 12, a feeding section 14, and a discharging section 16. The feeding section 14 and the discharging section 16 can be respectively positioned at opposite sides of the processing section 12.

The processing section 12 can be configured to partly receive the pressure casting mechanism 30, to ensure that the pressure casting mechanism 30 can be started to work in a vacuum condition. The processing section 12 can include a top wall 121, a bottom wall 123, a first sidewall 125, a second sidewall 127, and a first vacuum pump 129. The top wall 121 and the second wall 123 can be positioned opposite to each other. The first sidewall 125 and the second sidewall 127 can be positioned opposite to each other. Opposite ends of the first sidewall 125 can be respectively coupled to the top wall 121 and the bottom wall 123. Opposite ends of the second sidewall 127 can be respectively coupled to the top wall 121 and the bottom wall 123. In an alternative embodiment, the first sidewall 125 and the second sidewall 127 can be positioned adjacent to each other and coupled to each other. The first vacuum pump 129 can be coupled to the second sidewall 127, and can communicate with the processing section 12. The first vacuum pump 129 can be configured to vacuumize the processing section 12.

The feeding section 14 can be positioned at a side of the first sidewall 125, and can communicate with the processing section 12. The feeding section 14 can be configured to heat a raw material (not shown) into the molten material 200. The feeding section 14 can include a melting compartment 141 and a feeding compartment 143. The melting compartment 141 can communicate with the processing section 12.

The melting compartment 141 can be positioned outside of the first sidewall 124, and can provide a melting device 1411 (e.g., a heat source). The melting device 1411 can be configured to heat the raw material (not shown) in a solid state into the molten material 200.

The feeding compartment 143 can include a middle compartment 145 and a storage compartment 147. Opposite ends of the middle compartment 145 can communicate with the storage compartment 147 and the melting compartment 141, respectively. The middle compartment 145 can provide a first locking gate 1451 adjacent to the melting compartment 141, a second locking gate 1453 away from the melting compartment 141, and a second vacuum pump 1455 coupled to a sidewall of the middle compartment 145. The first locking gate 1451 can be controlled to close and seal the middle compartment 145, such that the middle compartment 145 can be completely cut off from the melting compartment 141, or when the middle compartment 145 is enclosed by the first locking gate 1451, the first locking gate 1451 can be controlled to open the middle compartment 145, such that the middle compartment 145 can communicate with the melting compartment 141. The second locking gate 1453 can be controlled to close and seal the middle compartment 145, such that the middle compartment 145 can be completely cut off from the storage compartment 147, or when the middle compartment 145 is enclosed by the second locking gate 1453, the second locking gate 1453 can be controlled to open the middle compartment 145, such that the middle compartment 145 can communicate with the storage compartment 147. The second vacuum pump 1455 can communicate with the middle compartment 145, and can be configured to vacuumize the middle compartment 145.

The storage compartment 147 can be positioned at a side of the middle compartment 145 adjacent to the second locking gate 1453. The storage compartment 147 can define an entrance 1471. The raw material in a solid state can be conveyed through the entrance 1471 into the storage compartment 147. The entrance 1471 can be covered by an external cover (not shown), and the second locking gate 1453 can be opened. The raw material can drop into the middle compartment 145 through the second locking gate 1453. The second locking gate 1453 can be closed and seal the middle compartment 145. The second vacuum pump 1455 can be started to make the middle compartment into a vacuum. The first locking gate 1451 can be opened and the raw material can drop into the melting device 1411 in the melting compartment 141.

The discharging section 16 can be positioned at a side of the second sidewall 137, and can communicate with the processing section 12. The discharging section 16 can provide a first gate 161 adjacent to the second sidewall 127, a second gate 163 away from the second sidewall 127, and a third vacuum pump 165 coupled to a sidewall of the discharging section 16. The first gate 161 can be controlled to close and seal the discharging section 16 such that the discharging section 16 can be completely cut off from the processing section 12, or when the discharging section 16 is enclose by the first gate 161, the first gate 161 can be controlled to open the discharging section 16, such that the discharging section 16 can communicate with the processing section 12. The second gate 163 can be controlled to close and seal the discharging section 16, such that the discharging section 16 can be completely cut off from the outside, or when the discharging section 16 is enclosed by the second gate 163, the second gate 163 can be controlled to open the discharging section 16, such that the discharging section 16 can communicate with the outside. The third vacuum pump 165 can communicate with the discharging section 16, and can be configured to vacuumize the discharging section 16.

Figure 2:
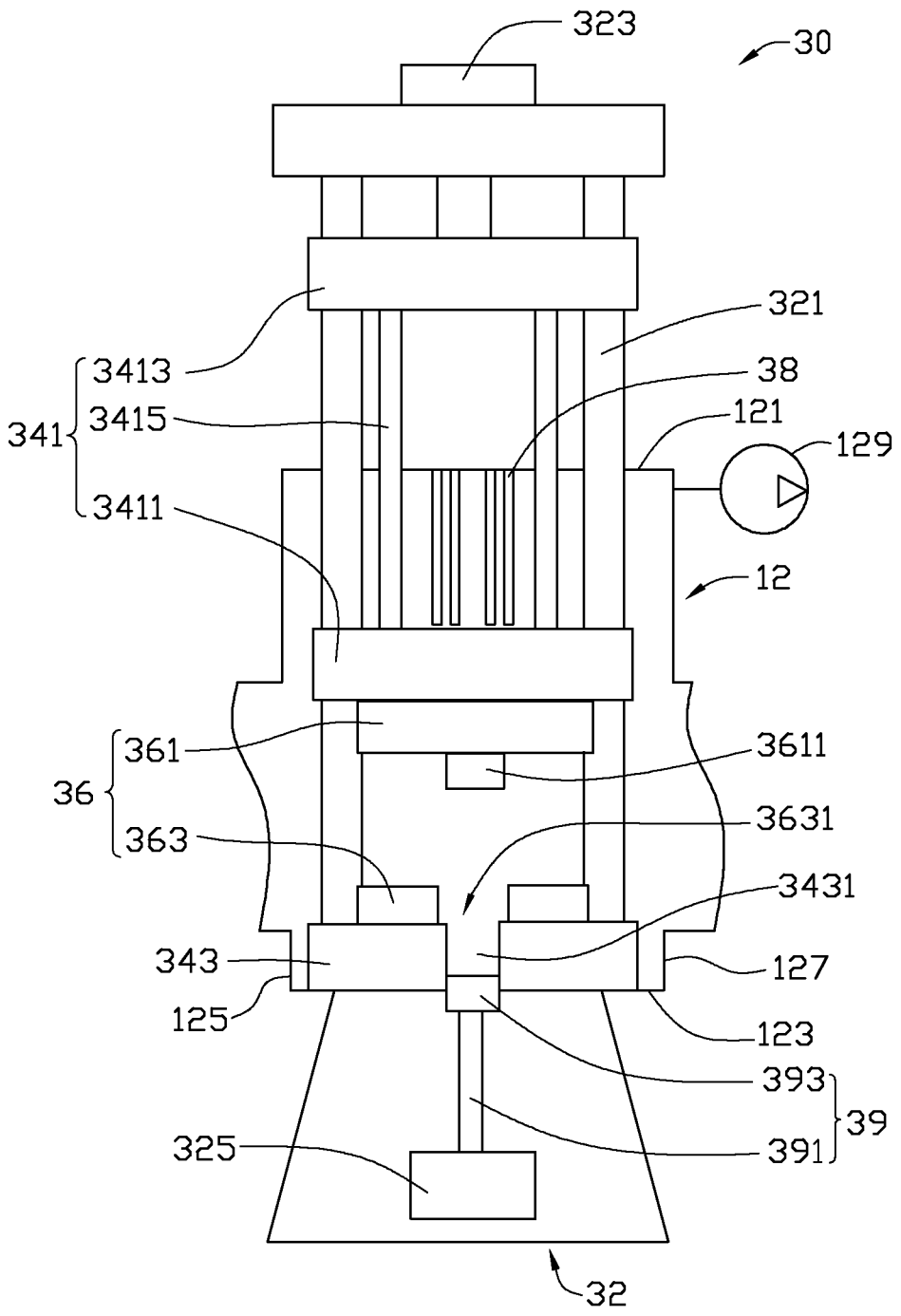
FIG. 2 is a diagrammatic view of the pressure casting mechanism of the pressure casting machine of FIG. 1.

FIG. 2 illustrates that the pressure casting mechanism 30 can be partly received in the processing section 12. The pressure casting mechanism 30 can be configured to mold the molten material 200. The pressure casting mechanism 30 can include a support 32, a basing block 34 coupled to the support 32, a mold 36 coupled to the basing block 34, a plurality of pushing members 38 coupled to the processing section 12, and an injecting member 39 coupled to the support 32.

The support 32 can be positioned on the ground adjacent to the processing section 12, configured to support the basing block 34. The support 32 can include two guiding rods 321 coupled to the top wall 121, a first driver 323 adjacent to the top wall 121, and a second driver 325 adjacent to the bottom wall 123.

The guiding rods 321 can be parallel to each other and configured to guide the basing block 34. An end of each of the guiding rods 321 can be inserted through the top wall 121 and received in the processing section 12. Each of the guiding rods 321 can be hermetically coupled to the top wall 121. In an alternative embodiment, there can be one or more guiding rods 321. The first driver 323 can be configured to move the basing block 34 and the mold 36 to complete a process of the mold closing and opening. The second driver 325 can be configured to move the injecting member 39 to complete a process of injection.

The basing block 34 can include a movable base 341 and a static base 343. The movable base 341 can be movably positioned on the guiding rods 321, and can be configured to slide along a longitude direction of each of the guiding rods 321. The movable base 341 can include a first base plate 3411, a second base plate 3413, and a connecting member 3415. The first base plate 3411 and the second base plate 3413 can be spaced from and parallel to each other. The connecting member 3415 can be positioned between the first base plate 3411 and the second base plate 3413.

The first base plate 3411 and the second base plate 3413 can be sleeved on the guiding rods 321, and respectively positioned at opposite sides of the top wall 121. The first base plate 3411 can be received in the processing section 12. The second base plate 3413 can be positioned outside of the processing section 12 and coupled to first driver 323. The connecting member 3415 can extend through the top wall 121, and can be hermetically coupled to the top wall 121. Opposite ends of the connecting member 3415 can be respectively coupled to the first base plate 3411 and the second base plate 3413. The first base plate 3411, the second base plate 3413, and the connecting member 3415 can slide along the longitude direction of the guiding members 321 when driven by the first driver 323.

The static base 343 can be received in the processing section 12 and fixed to the bottom wall 123. The static base 343 can define a through hole 3431. The through hole 3431 can be configured to provide an access for the injecting member 39 to be inserted through.

The mold 36 can include a first core 361 coupled to the first base plate 341, and a second core 363 coupled the static base 343 and opposite to the first core 361. In the illustrated embodiment, the first core 361 can be a male core, the second core 363 can be a female core. The first core 361 can provide a core insert 3611 on a surface facing the second core 363. The second core 363 can define a cavity insert 3631 communicating with the through hole 3431. The cavity insert 3631 can be configured to receive the core insert 3611 and can cooperate with the core insert 3611 to define a compression cavity configured to receive the molten material 200.

The pushing members 38 can be coupled to the top wall 121 and positioned between the top wall 121 and the first core 361. The pushing members 38 can be configured to push out a workpiece (not shown) molded from the molten material 200 on the first core 361. In the illustrated embodiment, each of the pushing members 38 can be a thin rod, and can be substantially perpendicular to the top wall 121. After the workpiece is molded, the first driver 323 can move the movable base 341 and the first core 361 away from the second core 363. The first core 361 can be moved to the pushing members 38, and the pushing members 38 can be inserted through the first basing plate 3411 and the first core 361, and protrude out of the surface of the first core 361 away from the first basing plate 3411, such that the workpiece can be pushed away from the first core 361.

The injecting member 39 can include a connecting portion 391 and an injecting portion 393 coupled to the connecting portion 391. The connecting portion 391 can be coupled to the second driver 325. The injecting portion 393 can be coupled to an end of the connecting portion 391 away from the second driver 325. The injecting portion 393 can be received in the through hole 3431 and hermetically coupled to a periphery of the through hole 3431. The second driver 325 can be configured to drive the injecting portion 393 to be inserted into the cavity insert 3631. Such that the molten material 200 in the compression cavity can be compressed to mold the workpiece.

FIG. 1 illustrates that the feeding mechanism 50 can be positioned adjacent to the feeding section 14. The feeding mechanism 50 can include a mechanical arm 52, a sealing member 521 coupled to the melting compartment 141, and a receiving member 54 coupled to the mechanical arm 52.

The mechanical arm 52 can be movably inserted through a sidewall of the melting compartment 141. The sealing member 521 can be positioned between the mechanical arm 52 and the sidewall of the melting compartment 141, such that the mechanical arm 52 can be hermetically coupled to the sidewall. The receiving member 54 can be positioned at an end of the mechanical arm 52 received in the melting compartment 141. The receiving member 54 can be positioned above the melting device 1411, and can be aligned to the first locking gate 1451. The receiving member 54 can be configured to receive the raw material dropping from the first locking gate 1451 such that the melting device 1411 can heat the raw material in the receiving member 54 into the molten material 200. The mechanical arm 52 can be configured to move the receiving member 54 with the molten material 200 towards the pressure casting mechanism 20 in the processing section 12.

The picking mechanism 70 can be positioned adjacent the discharging section 16. In the illustrated embodiment, the picking mechanism 70 can be a mechanical arm. The picking mechanism 70 can include a driving rod 72, a sealing member 721 coupled to the second gate 163, and a picking portion 74 coupled to the driving rod 72.

The driving rod 72 can be movably inserted through the second gate 163. The sealing member 721 can be positioned between the driving rod 72 and the second gate 163, such that the driving rod 72 can be hermetically coupled to the second gate 163. The picking portion 74 can be coupled to an end of the driving rod 72 received in the discharging section 16. The driving rod 72 can be configured to move the picking portion 74 towards the processing section 12 to pick up the workpiece and take the workpiece out of the pressure casting machine 100.

In assembly, the static base 343 can be coupled to the bottom wall 123. The second core 363 can be fixed to the static base 343. The pushing members 38 can be coupled to the top wall 121. The supporting 32 can be positioned adjacent to the vacuum chamber 10. An end of each of the guiding rods 321 can be inserted through the top wall 121 and received in the processing section 12. The movable base 341 can be slidably sleeved on the guiding rods 321. The first basing plate 3411 and the second basing plate 3413 can be positioned at opposite sides of the top wall 121, respectively. The first driver 323 can be coupled to the movable base 341. The injecting member 39 can be positioned adjacent to the static base 343 and the injecting portion 393 can be inserted into the through hole 3431. The second driver 325 can be coupled to the injecting member 39. The feeding mechanism 50 can be positioned adjacent to the feeding section 14 and the picking mechanism 70 can be positioned adjacent to the discharging section 16.

In operation, the first locking gate 145, the second locking gate 1453, the first gate 161, and the second gate 163 can be closed before the machining processor is started. The raw material in solid state can be conveyed into the storage compartment 147. The first vacuum pump 129 can vacuumize the processing section 12, to make the processing section 12 and the melting compartment 141 to be in a vacuum condition. The second locking gate 1453 can be opened and the raw material can drop into the middle compartment 145. The second locking gate 1453 can be closed and the second vacuum pump 1455 can vacuumize the middle compartment 145 to make the middle compartment 145 a vacuum. The first locking gate 1451 can be opened and the raw material can drop into the receiving member 54 under the second locking gate 1451. The first locking gate 1451 can be closed and the melting device 1411 can heat the raw material into the molten material 200. The mechanical arm 52 can move the receiving member 54 with the molten material 200 into the processing section 12, and the molten material 200 can be poured into the cavity insert 3631. The mechanical arm 52 can move the receiving member 54 back to the melting compartment 141. The first driver 323 can drive the movable base 341 and the first core 361 to move towards the second core 363. Such that the core insert 3611 can be inserted into the cavity insert 3631, the molten material 200 can be forced to fill the compression cavity. The second driver 325 can rapidly move the injecting member 39 towards the through hole 3431, the injecting portion 393 can be inserted into the compression cavity and press the molten material 200 in the compression cavity. The molten material 200 can be forced to fill the compression cavity and molded into the workpiece.

The first driver 323 can move the first core 361 back to the top wall 121, with the workpiece on the core inset 3611. The first core 361 can be moved to the pushing members 38. The pushing members 38 can be inserted through the first base plate 3411 and the first core 361 and protrude out of the surface of the first core 361 away from the first basing plate 3411, such that the workpiece can be pushed away from the core insert 3611. The workpiece can fall onto the second core 363.

The second gate 163 can be opened, the driving rod 72 can move the picking portion 74 into the discharging section 16, and the second gate 163 can be closed. The third vacuum pump 165 can vacuumize the discharging section 16 to make the discharging section 16 to be a vacuum. The first gate 161 can be opened; the driving rod 72 can move the picking portion 74 to pick up the workpiece from the second core 363, and take the workpiece into the discharging section 16. The first gate 161 can be closed, and the second gate 163 can be opened. The driving rod 72 can drive the picking portion 74 to take the workpiece out of the discharging section 16.

In an alternative embodiment, the first gate 161 can be coupled to the processing section 12, and the feeding section 14 and the discharging section 16 can be omitted. Thereby, the first gate 161 can be controlled to close and seal the processing section 12 such that processing section 12 can be completely cut off from the outside, or when the processing section 12 is enclosed by the first gate 161, the first gate 161 can be controlled to open the processing section 12 such that the processing section 12 can communicate with the outside.

In another alternative embodiment, the injection member 39 and the second driver 325 can be omitted. In operation, the first driver 323 can drive the movable base 341 and the first core 361 to move towards the second core 363 such that the core insert 3611 can be inserted into the cavity insert 3631, and the molten material 200 can be forced to fill the compression cavity and molded into the workpiece.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure, as defined by the appended claims.

What is claimed is:

1. A pressure casting machine configured to mold a molten material into a workpiece, the pressure casting machine comprising:

a vacuum chamber comprising:

a processing section comprising:

a top wall; and a bottom wall opposite to the top wall;

a first gate configured to seal the processing section; and a first vacuum pump coupled to the processing section;

a feeding section, comprising a melting compartment communicating with the processing section, and a melting device positioned in the melting compartment, the melting device configured to heat a raw material into the molten material; and a pressure casting mechanism comprising:

a first driver positioned adjacent to the top wall;

a first core received in the processing section and coupled to the first driver;

a second core received in the processing section, and coupled to the bottom wall and opposite to the first core; and a plurality of pushing members received in the processing section and coupled to the top wall, and positioned between the top wall and the first core; wherein the first driver is configured to move the first core to engage with the second core to complete a molding processor, and move the first core away from the second core and towards the pushing members, enabling the pushing members to insert through the first core and push out the workpiece on the first core, wherein the processing section further comprises a first sidewall, opposite sides of the first sidewall are coupled to the top wall and the bottom wall respectively, and the feeding section is coupled to the first sidewall.

2. The pressure casting machine of claim 1, wherein the pressure casting mechanism further comprises a movable base and a static base, the movable base is coupled to the first driver and partly received in the processing section, the first core is coupled to the movable base; the static base is coupled to the bottom wall and received in the processing section, the second core is coupled to the static base.

3. The pressure casting machine of claim 2, wherein the pressure casting mechanism further comprises a support adjacent to the processing section, the support comprises at least one guiding rod, an end of the at least one guiding rod extends through the top wall and received in the processing section; the movable base comprises a first basing plate and a second basing plate spaced and parallel to each other, and a connecting member positioned between the first basing plate; the first basing plate and the second basing plate are sleeved on the at least one guiding rod.

4. The pressure casting machine of claim 3, wherein the pressure casting mechanism further comprises a core insert formed on a surface of the first core facing the second core; the second core defines a cavity insert configured to cooperate with the core insert to define a compression cavity.

5. The pressure casting machine of claim 4, wherein the pressure casting mechanism further comprises a second driver coupled to the support and adjacent to the bottom wall, and an injecting member coupled to the second driver; the injecting member comprises a connecting portion coupled to the second driver and an injecting portion extending through the bottom wall; the second driver is configured to move the injecting portion to protrude into the cavity insert.

6. The pressure casting machine of claim 1, wherein the feeding section further comprises a middle compartment, a storage compartment, a first locking gate a second locking gate, and a second vacuum pump; opposite ends of the middle compartment communicate with the storage compartment and the melting compartment respectively, the first locking gate is coupled to the middle compartment adjacent to the melting compartment, the second locking gate is coupled to the middle compartment adjacent to the storage compartment; the second vacuum pump is coupled to the middle compartment; the storage compartment defines an entrance at a side away from the middle compartment.

7. The pressure casting machine of claim 6, wherein the pressure casting mechanism further comprises a feeding mechanism adjacent to the feeding section; the feeding mechanism comprises a mechanical arm, a sealing member, and a receiving member; the mechanical arm extends through a sidewall of the melting compartment; the sealing member is positioned between the mechanical arm and the melting compartment; the receiving member is coupled to the mechanical arm and received in the melting compartment.

8. The pressure casting machine of claim 1, wherein the processing section further comprises a second sidewall, opposite sides of the second sidewall are coupled to the top wall and the bottom wall respectively; the vacuum chamber further comprises a discharging section coupled to the second sidewall, a second gate couple to the discharging section, and a third vacuum pump coupled to the discharging section; the first gate is positioned at a side of the discharging section adjacent to the second sidewall; the second gate is positioned at a side of the discharging section away from the second sidewall.

9. The pressure casting machine of claim 8, wherein the pressure casting machine further comprises a picking mechanism adjacent to the discharging section, the picking mechanism comprises a driving rod, a sealing member coupled to the second gate, and a picking portion coupled to the driving rod; the driving rod is configured to extend through the second gate and move the picking portion to pick up and take out the workpiece on the pressure casting mechanism; the sealing member is positioned between the driving rod and the second gate.

10. A pressure casting machine comprising:

a vacuum chamber comprising:

a processing section having a top wall and a bottom wall opposite to the top wall;

a first gate configured to seal the processing section; and a vacuum pump coupled to the processing section;

a discharging section, a second gate coupled to the discharging section, and a vacuum pump coupled to the discharging section, wherein the first gate and the second gate are positioned at two opposite sides of the discharging section, and a pressure casting mechanism comprising:

a first core received in the processing section;

a second core received in the processing section, and coupled to the bottom wall and opposite to the first core;

a plurality of pushing members received in the processing section and coupled to the top wall, and positioned between the top wall and the first core; and a first driver positioned adjacent to the top wall and coupled to the first core, configured to move the first core to engage with the second core.

11. The pressure casting machine of claim 10, wherein the pressure casting mechanism further comprises a movable base and a static base, the movable base is coupled to the first driver and partly received in the processing section, the first core is coupled to the movable base; the static base is coupled to the bottom wall and received in the processing section, the second core is coupled to the static base.

12. The pressure casting machine of claim 11, wherein the pressure casting mechanism further comprises a support adjacent to the processing section, the support comprises at least one guiding rod, an end of the at least one guiding rod extends through the top wall and received in the processing section; the movable base comprises a first basing plate and a second basing plate spaced and parallel to each other, and a connecting member positioned between the first basing plate; the first basing plate and the second basing plate are sleeved on the at least one guiding rod.

13. The pressure casting machine of claim 12, wherein the pressure casting mechanism further comprises a core insert formed on a surface of the first core facing the second core; the second core defines a cavity insert configured to cooperate with the core insert to define a compression cavity.

14. The pressure casting machine of claim 13, wherein the pressure casting mechanism further comprises a second driver coupled to the support and adjacent to the bottom wall, and an injecting member coupled to the second driver; the injecting member comprises a connecting portion coupled to the second driver and an injecting portion extending through the bottom wall; the second driver is configured to move the injecting portion to protrude into the cavity insert.

15. The pressure casting machine of claim 10, wherein the processing section further comprises a first sidewall, opposite sides of the first sidewall are coupled to the top wall and the bottom wall respectively; the vacuum chamber further comprises a feeding section coupled to the first sidewall; the feeding section comprises a melting compartment communicating with the processing section, and a melting device positioned in the melting compartment.

16. The pressure casting machine of claim 15, wherein the feeding section further comprises a middle compartment, a storage compartment, a first locking gate a second locking gate, and a vacuum pump coupled to the middle compartment; opposite ends of the middle compartment communicate with the storage compartment and the melting compartment respectively, the first locking gate is coupled to the middle compartment adjacent to the melting compartment, the second locking gate is coupled to the middle compartment adjacent to the storage compartment; the storage compartment defines an entrance at a side away from the middle compartment.

17. The pressure casting machine of claim 16, wherein the pressure casting mechanism further comprises a feeding mechanism adjacent to the feeding section; the feeding mechanism comprises a mechanical arm, a sealing member, and a receiving member; the mechanical arm extends through a sidewall of the melting compartment; the sealing member is positioned between the mechanical arm and the melting compartment; the receiving member is coupled to the mechanical arm and received in the melting compartment.

18. The pressure casting machine of claim 10, wherein the processing section further comprises a second sidewall, opposite sides of the second sidewall are coupled to the top wall and the bottom wall respectively, the discharging section is coupled to the second sidewall; the first gate is positioned at a side of the discharging section adjacent to the second sidewall; the second gate is positioned at a side of the discharging section away from the second sidewall.

19. A pressure casting machine configured to mold a molten material into a workpiece, the pressure casting machine comprising:

a processing section;

a first gate configured to seal the processing section;

a first vacuum pump coupled to the processing section;

a first driver positioned adjacent a top of the processing section;

a first core located in the processing section and coupled to the first driver;

a second core located in the processing section, coupled to a bottom of the processing section, and opposite to the first core; and at least one pushing member between the top and the first core;

wherein the first driver is configured to move the first core toward and into engagement with the second core to define a mold, and to move the first core away from the second core and into engagement with the pushing members, whereby the pushing members insert through the first core and dislodge the workpiece out of the first core, the vacuum chamber further comprises a feeding section, and a discharging section, the feeding section and the discharging section are respectively positioned at opposite sides of the processing section.

* * * * *